United States Patent [19]

Fournier et al.

[11] Patent Number: 4,966,100

[45] **Date of Patent: * Oct. 30, 1990**

[54] DEVICE FOR PROTECTING SCREENS IN BOILERS, AND IN PARTICULAR FOR GARBAGE INCINERATORS, AND PROCEDURE FOR MANUFACTURE OF THIS DEVICE

[75] Inventors: Jean Fournier, Rochefort en Yvelines; Adrian Casariego, Velizy Villacoublay, both of France

[73] Assignee: Societe Anonyme dite: Stein Industrie, Velizy-Villacoublay, France

[ * ] Notice: The portion of the term of this patent subsequent to Mar. 7, 2006 has been disclaimed.

[21] Appl. No.: 396,702

[22] Filed: Aug. 22, 1989

[30] Foreign Application Priority Data

Aug. 22, 1988 [FR] France ..... 88 11095

[51] Int. Cl.[5] ..... F22B 37/00

[52] U.S. Cl. ..... 122/6 A; 122/DIG. 13; 29/890.051

[58] Field of Search ..... 122/6 A, DIG. 13; 110/334, 338, 339, 336; 29/157.4

[56] References Cited

U.S. PATENT DOCUMENTS

| | | | |
|---|---|---|---|
| 2,713,787 | 7/1955 | Rose | 110/336 |
| 3,828,735 | 8/1974 | Graham et al. | 122/6 A |
| 3,838,665 | 10/1974 | Astrom | 122/6 A |
| 3,850,146 | 11/1974 | Graham et al. | 122/6 A |
| 4,768,447 | 9/1988 | Roumeguere | 110/338 |
| 4,809,621 | 3/1989 | Materna | 110/336 |
| 4,809,645 | 3/1989 | Fournier et al. | 122/6 A |

FOREIGN PATENT DOCUMENTS

| | | |
|---|---|---|
| 2343981 | 10/1977 | France . |
| 2495284 | 6/1982 | France . |
| 561814 | 6/1944 | United Kingdom . |

*Primary Examiner*—Edward G. Favors
*Assistant Examiner*—Denise L. Ferensic
*Attorney, Agent, or Firm*—Sughrue, Mion, Zinn, Macpeak & Seas

[57] ABSTRACT

Device for the protection of boiler screens, in particular for garbage incinerators, and manufacturing process for this device. Device for protection of screens used for heat-recovery boilers, composed of vertical tubes 1, 14 joined together using welded ribs (17) installed between fireproof bricks and fitted with means for fastening them, these tubes being equipped with vertical auxiliary fastening ribs 2, 11; 3, 13 forming an angle of between 30° and 60° with the plane of the ribs 17, and made discontinuous at intervals on the vertical sections of the tubes. A first series of bricks in fastened on the upper portion of the auxiliary ribs. A second series of bricks 6, 18, alternating with the bricks of the first series, has a general dovetail shape and is fixed in position between recesses 7, 8 in the bricks of the first series. Process for the manufacture of this device.

6 Claims, 2 Drawing Sheets

DEVICE FOR PROTECTING SCREENS IN BOILERS, AND IN PARTICULAR FOR GARBAGE INCINERATORS, AND PROCEDURE FOR MANUFACTURE OF THIS DEVICE present invention concerns a protective device for screens of heat-recovery boilers, and in particular for garbage incinerators, these screens being composed of vertical tubes joined together using welded joining ribs which are installed behind fireproof bricks and equipped with means for attaching onto these bricks, these tubes being equipped with auxiliary vertical fastening ribs forming an angle of between 30° and 60° with the plane of the joining ribs and being discontinuous at intervals on the vertical sections of the tubes, a first series of bricks being equipped, on their lower portions, with vertical grooves having a width and thickness equal to those of the auxiliary ribs, extending only over a fraction of their height beginning at the base, and being fastened on the upper portion of the auxiliary ribs, and a fireproof cement inserted, first, between the bricks and second, the tubes and the ribs.

The Applicant has already, in Pat. No. FR-A-2,611,864 of Feb. 27, 1987, or U.S. Pat. No. 4,809,645, proposed a protective device of this kind, incorporating auxiliary ribs made regularly discontinuous at certain vertical gaps, a first portion of the fireproof bricks, having vertical grooves extending over only a fraction of their height beginning at the base, being fastened onto the auxiliary ribs, and another portion of the bricks, normally greater in number, having vertical grooves extending over their entire height, these latter being arranged in rows on the auxiliary ribs above the bricks composing the first portion.

Although this device is effective, it presents problems of installation and the risk of long-term corrosion. In fact, the gaps existing between the bricks on the one hand, and the tubes, the joining ribs and the auxiliary ribs on the other, must be filled with a cement ensuring the proper attachment of the bricks to each other and the impermeability of the screen formed in this way. But, when the bricks having vertical grooves over their entire height are made to slide on the auxiliary ribs, these bricks remove a portion of the cement laid down against the tubes and the ribs, so that the bonding between these bricks and the tubes and ribs becomes poorly maintained and does not possess the proper impermeability. The tubes and ribs are at that moment subjected to the threat of corrosion and deterioration caused by the furnace fumes which penetrate until they come into contact with them.

The purpose of the present invention is to create a boiler-screen protection device which is as effective as the one contained in the patent application mentioned above, but which is more easily installed, has greater impermeability, and avoids the risks of corrosion to the tubes and ribs from the furnace fumes.

The device according to the invention is characterized by the fact that a second series of bricks, alternating with the bricks making up the first series, has at its upper and lower ends inside recesses which give them the general shape of dovetails, and by the fact that the bricks of the first series have corresponding recesses to ensure that they will interlock in position with the bricks making up the second series.

The auxiliary ribs of the tubes are preferably of a height approaching half the height of the bricks in the first series.

Preferably also, the auxiliary ribs are attached to the tubes by full-penetration welds and having a width and thickness such that their temperature is very close to that of the tubes themselves.

The heights of the bricks making up the first and second series are advantageously equal.

The manufacturing process for a device of this kind according to the invention, is characterized by that fact that tubes are arranged parallel to each other in one plane; next, they are gathered together using joining ribs welded between the adjacent tubes; then, parts of the auxiliary fastening ribs are welded onto the tubes, thus forming an angle of between 30° and 60° with the general plane of the axes of the tubes, at a height corresponding to a fraction of the height of a first series of fireproof bricks having vertical grooves matching up with the auxiliary ribs and having inner recesses which enlarge as they extend toward the furnace body and at intervals corresponding to at least the height of the bricks composing a second series, these latter not having vertical grooves but containing recesses which fit together with the recesses of the bricks in the first series; the process is also characterized by the fact that the surfaces of the tubes, of the joining ribs, and of the auxiliary ribs, on the top of a first lower row of bricks making up the first series, are covered with a coating of fireproof cement; that a horizontal row of bricks composing the first series is fastened onto the auxiliary ribs of this first row; that the surfaces of the tubes, of the joining ribs, and of the upper recesses of the bricks of the first series thus laid down are covered with a coating of fireproof cement; that a horizontal row of bricks of the second series is placed above the bricks in this first row; that the surfaces of the tubes, of the joining ribs, of the auxiliary ribs of the upper horizontal row, and of the recesses of the bricks making up the second series thus laid down are covered with a coating of fireproof cement; that another horizontal row of bricks composing the first series is fastened onto the auxiliary ribs of this upper horizontal row, and so on, until the top of the protective screen is reached.

A boiler-screen protection device according to the invention, and the process for its manufacture, are described below as an example and with reference to the attached drawings.

Figure 1:
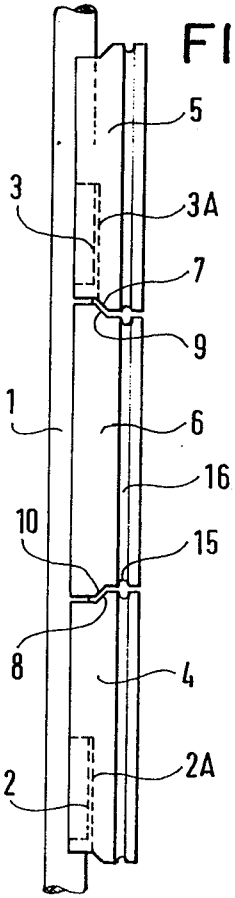
FIG. 1 shows the interlocking of the bricks making up both series of bricks, in a section made through a vertical plane (axis I—I in FIGS. 2 through 4).

In FIG. 1, two bricks 4 and 5 in the first series and one brick 6 in the second series are represented.

Bricks 4 and 5 are fastened, by means of the grooves in their lower half 2A, 3A, onto auxiliary ribs 2 and 3 welded onto tube 1 (or 11 and 13 on tube 14). Brick 4 incorporates an upper inner recess and brick 5, a lower recess 7, making it possible to hold brick 6 in position, this latter brick having corresponding recess 10 and 9, and these three bricks making up a dovetailed assembly, and the space remaining between recesses 7 and 9, on the one hand, and 8 and 10 on the other, being filled with a fireproof cement, as is the case for the space existing between the fireproof bricks and the tubes and ribs. Horizontal grooves, such as 15, and vertical grooves, such as 16, allow the positioning of impermeable joints between the bricks, in a conventional manner.

Figure 2:
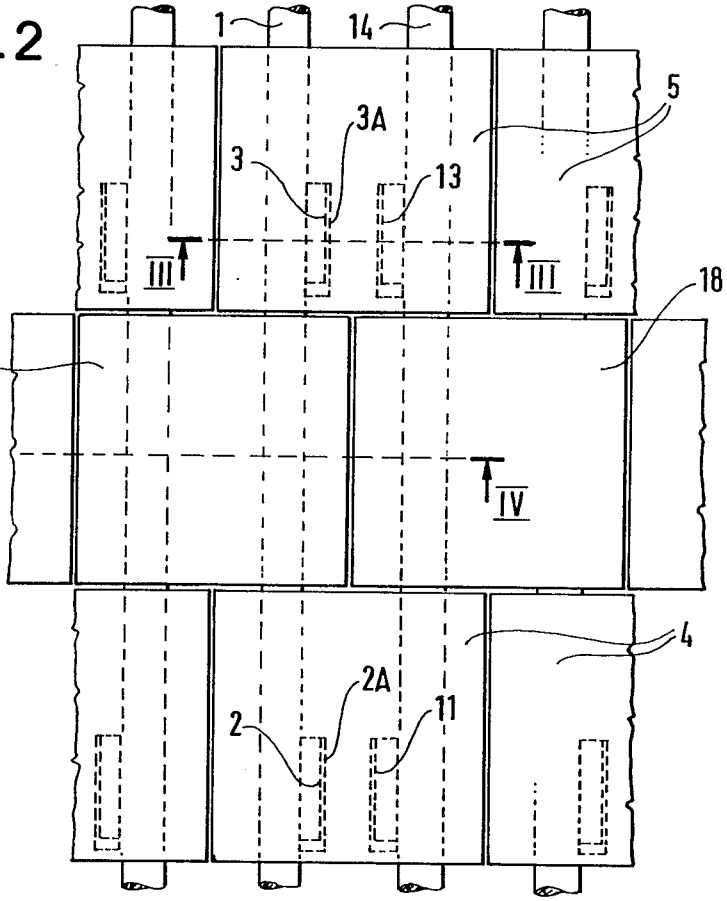
FIG. 2 illustrates a raised view of a portion of the device.

FIG. 2 shows the bricks as they rise. The bricks in the first series, such as 4 and 5, and in the second series, such as 6 and 18, are positioned in an alternating arrangement, one brick from the second series being placed above and below two bricks from the first series, and vice-versa.

Figure 3:
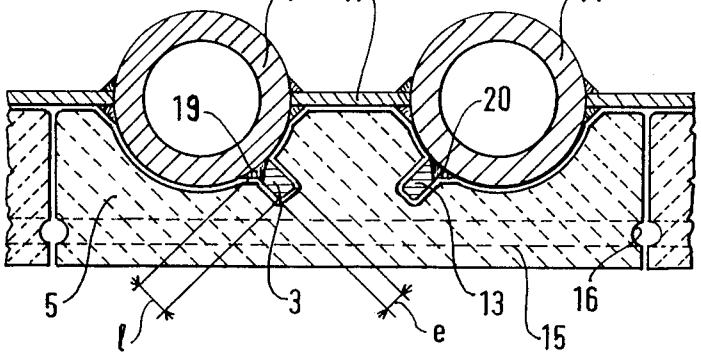
FIG. 3 illustrates a section through a horizontal plane cutting across a fireproof brick in the first series (axis III—III in FIGS. 1 and 2).
Figure 4:
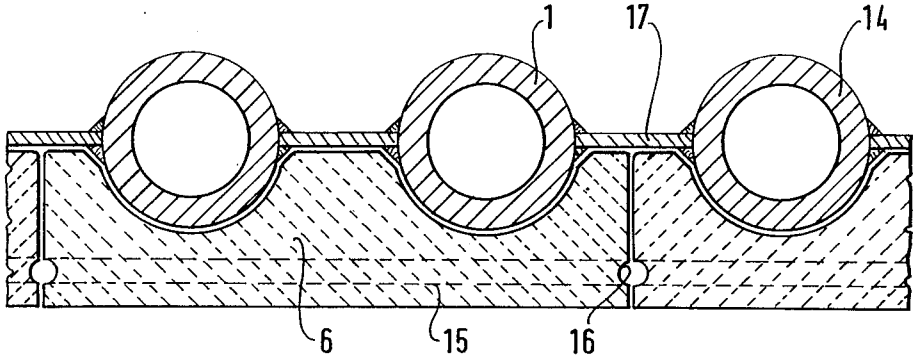
FIG. 4 shows a section through a horizontal plane cutting across a fireproof brick in the second series (axis IV—IV in FIGS. 1 and 2).

FIGS. 3 and 4 illustrate the bricks in cross-section along horizontal planes (axes III—III and IV—IV, respectively, in FIGS. 1 and 2). Tubes 1 and 14 are joined together by means of a joining rib 17, and are fitted with auxiliary fastening ribs 3 and 13 attached to them using full-penetration welds (welds 19, 20) and forming an angle of 45° with the plane of the tube axes. The width 1 and the thickness e of these ribs are such that their temperature is approximately equal to that of tubes 1 and 14.

To position the screen, tubes such as 1 and 14 are arranged in a plane and joining ribs, such as 17, are welded together, for example using an automatic welding machine using a consumable welding wire. Then, auxiliary ribs 2 and 3 are welded onto these tubes at spaced levels having the height of one brick in the second series, such as 6, and of approximately half of one brick in the first series, such as 4. A coating of fireproof cement is spread on the tubes, the joining ribs and the auxiliary ribs, such as 2, at the top of the fireproof bricks. Bricks 4 are fastened onto these auxiliary ribs 2. Next, the surfaces of the tubes, of the joining ribs, and of the upper recess 8 of bricks 4 are covered with a coating of fireproof cement. Bricks in the second series, such as 6, 18, are positioned; they are held temporarily in place by the support provided by their lower recess 9 resting in the upper recesses 7 of the bricks 4. Once again, the surface of the tubes, of the joining ribs, and of the upper recesses of the bricks 6, 18 are covered with a coating of fireproof cement. A row of bricks in the first series 5 is fastened onto the auxiliary ribs 3. Step by step, this operation is begun once again beginning with this row of bricks, until the complete screen-protection device is obtained.

What is claimed:

1. Device for the protection of heat-recovery boiler screens, in particular for garbage incinerators, these screens being constructed using vertical tubes (1, 14) joined together by welded joining ribs (17) installed behind fireproof bricks and equipped with means for fastening to said bricks, said tubes having vertical fastening ribs (2, 11; 3, 13) forming an angle of between 30° and 60° with the plane of the joining ribs, which are made discontinuous at intervals on the vertical sections of the tubes, a first series of fireproof bricks (4, 5) having, in their lower portion, vertical grooves (2A, 3A) having a width and thickness corresponding to those of the auxiliary ribs, and extending over only a fraction of their height beginning at the base and being fastened onto the upper portion of the auxiliary ribs, a fireproof cement being spread between the fireproof bricks on the one hand, and the tubes and the ribs on the other; wherein a second series of bricks (6, 18), alternating with the bricks of the first series, has at its upper and lower ends, inside recesses (9, 10) imparting to them a general dovetail shape, and wherein the bricks making up the first series have corresponding recesses (7, 8) ensuring the interlocking in position of the bricks composing the second series.

2. Device according to claim 1, wherein the auxiliary ribs (2, 11; 3, 13) of the tubes are of a height approaching half of the height of the bricks in the first series (4, 5).

3. Device according to claim 2, wherein the auxiliary ribs are connected to the tubes by full-penetration welds and have a width and thickness such that their temperature very nearly approximates that of the tubes themselves.

4. Device according to claim 1, wherein the auxiliary ribs are connected to the tubes by full-penetration welds, and have a width and thickness such that their temperature very nearly approximates that of the tubes themselves.

5. Device according to claim 1, wherein the heights of the bricks of the first and second series (4, 5; 6, 18) are equal.

6. Manufacturing process for production of the boiler screen protective device wherein tubes (1, 14) are arranged parallel to each other in one plane; next, they are gathered together using joining ribs (17) welded between the adjacent tubes; then, parts of the auxiliary fastening ribs (2, 11; 3, 13) are welded onto the tubes, thus forming an angle of between 30° and 60° with the general plane of the axes of the tubes, at a height corresponding to a fraction of the height of a first series of fireproof bricks (4, 5) having vertical grooves matching up with the auxiliary ribs and having inner recesses (7, 8) which enlarge as they extend toward the furnace body and at intervals corresponding to at least the height of the bricks (6, 10) composing a second series, these latter not having vertical grooves but containing recesses (9, 10) which fit together with the recesses of the bricks in the first series; the process is also characterized by the fact that the surfaces of the tubes, of the joining ribs, and of the auxiliary ribs, on top of a first lower row of bricks making up the first series, are covered with a coating of fireproof cement; that a horizontal row of bricks composing the first series (4) is fastened onto the auxiliary ribs of this first row; that the surfaces of the tubes, of the joining ribs, and of the upper recesses (8) of the bricks of the first series thus laid down are covered with a coating of fireproof cement; that a horizontal row of bricks of the second series (6, 18) is placed above the bricks in this first row; that the surfaces of the tubes, of the joining ribs, of the auxiliary ribs of the upper horizontal row, and of the recesses of the bricks making up the second series thus laid down are covered with a coating of fireproof cement; that another horizontal row (5) of bricks composing the first series is fastened onto the auxiliary ribs of this upper horizontal row, and so on, until the top of the protective screen is reached.

* * * * *